United States Patent [19]

Tinnes et al.

[11] Patent Number: 4,747,580

[45] Date of Patent: May 31, 1988

[54] PAIR OF REFRACTORY PLATES FOR SWIVELLING OR ROTARY SLIDING CLOSURE UNIT AND METHOD OF OPERATION THEREOF

[75] Inventors: Bernhard Tinnes, Zollikerberg; Walter Vetterli, Winterthur, both of Switzerland

[73] Assignee: Metacon Ag, Zürich, Switzerland

[21] Appl. No.: 743,964

[22] Filed: Jun. 12, 1985

[30] Foreign Application Priority Data

Jun. 22, 1984 [DE] Fed. Rep. of Germany ..... 3423157

[51] Int. Cl.[4] ..... B22D 41/08

[52] U.S. Cl. ..... 266/44; 266/287; 222/600; 222/598

[58] Field of Search ..... 266/44, 287, 271, 275, 266/236; 222/600, 598, 599

[56] References Cited

U.S. PATENT DOCUMENTS 3,850,351 11/1974 Yoshihara ..... 222/598
4,498,611 2/1985 Yoshihara ..... 222/599
4,543,981 10/1985 Bates et al. ..... 222/598

FOREIGN PATENT DOCUMENTS 1928400 1/1974 Fed. Rep. of Germany .
2404425 8/1974 Fed. Rep. of Germany .
2840171 3/1980 Fed. Rep. of Germany .

*Primary Examiner*—L. Dewayne Rutledge
*Assistant Examiner*—S. Kastler
*Attorney, Agent, or Firm*—Wenderoth, Lind & Ponack

[57] ABSTRACT

A pair of refractory plates includes a stationary bottom plate having a discharge opening and a movable plate having two discharge openings. The movable plate is mounted for sliding movement with respect to the bottom plate about a center of rotation between a center closed position and opposite open positions. The discharge openings of the movable and bottom plates are centered on a common circular arc centered about the center of rotation, and the discharge openings of the movable plate are positioned symmetrically on opposite sides of the discharge opening of the bottom plate in the closed position. The bottom plate has a second discharge opening at a position between the circular arc and the center of rotation. The discharge openings of the bottom plate are centered on a radial line extending from the center of rotation and intersecting the circular arc, such radial line corresponding to a radial center line between the discharge openings of the movable plate in the closed position.

5 Claims, 2 Drawing Sheets

PAIR OF REFRACTORY PLATES FOR SWIVELLING OR ROTARY SLIDING CLOSURE UNIT AND METHOD OF OPERATION THEREOF

BACKGROUND OF THE INVENTION

The present invention relates to a pair of refractory plates for use in a swivelling or rotary sliding closure unit or slide gate, particularly for controlling the discharge of molten metal from a metallurgical vessel, more particularly for casting of molten steel. The present invention more particularly relates to such a pair of refractory plates including a stationary bottom plate having a discharge opening and adapted to be mounted beneath a vessel with the discharge opening aligned with an outlet opening of the vessel, and a movable plate having two discharge openings, the movable plate being mounted for sliding movement with respect to the bottom plate about a center of rotation between a closed position, whereat neither of the discharge openings of the movable plate are aligned with the discharge opening of the bottom plate, and alternate open positions, whereat respective of the discharge openings of the movable plate are in alignment with the discharge opening of the bottom plate, the discharge openings of the movable and bottom plates being centered on a common circular arc centered about the center of rotation, and the discharge openings of the movable plate being positioned symmetrically on opposite sides of the discharge opening of the bottom plate in the closed position. The present invention also is directed to a novel method of operation of such pair of refractory plates.

An example of this type of structure is shown in West German DE-PS No. 28 40 171, wherein there are a pair of refractory plates employed in a closing mechanism for the bottom nozzle of a ladle, and wherein discharge openings of the sliding or movable plate are moved, as required, from opposite sides to align with the discharge opening of the bottom plate and the outlet opening of the ladle. This arrangement results in a premature wear of the bottom plate compared with the movable plate, since the closing or throttling operations of the discharge of the molten metal are achieved by two discharge openings in the movable plate and by only a single discharge opening in the bottom plate. Therefore, the bottom plate must be replaced much more frequently than the movable plate, and this requirement is detrimental to continuous operation.

Additionally, West German DE-PS No. 24 04 425 discloses a rotary slide valve with a central plate assigned to the stationary bottom plate and having a plurality of discharge openings that can be positioned beneath the outlet opening of a vessel, regardless of the closing and opening operation of the movable plate and which acts as the actual bottom plate with discharge openings which can be alternated after wear. The central plate is adjusted by an expensive and complicated drive mechanism which results in this arrangement not being satisfactory for all operating conditions.

SUMMARY OF THE INVENTION

With the above discussion in mind, it is a primary object of the present invention to provide a pair of refractory plates of the above general type, but wherein it is possible to overcome the above and other prior art disadvantages.

It is a further object of the present invention to provide such a pair of refractory plates whereby it is possible to increase the service life of the bottom plate, thereby reducing the frequency of replacement thereof and increasing the operating efficiency of a discharge operation.

It is a further object of the present invention to provide such a pair of plates having a geometry and configuration optimizing material and operating costs.

It is a further object of the present invention to provide a novel method of operation of such improved pair of refractory plates.

These and other objects are achieved in accordance with the present invention by the provision that the bottom plate has therein a second discharge opening at a position between the circular arc and the center of rotation. The two discharge openings of the bottom plate are centered on a radial line extending from the center of rotation and intersecting the circular arc, and such radial line corresponds to a radial center line between the discharge openings of the movable plate in the closed position. In this manner, particularly in the case of a mortar-free bottom plate, it is quite easy, after depletion or wear of one discharge opening of the bottom plate, simply to rotate the bottom plate by 180° in the sliding plane to bring the second discharge opening thereof to a position aligned with the outlet opening of the vessel. As a result, the service life of the bottom plate is increased, and the bottom plate requires replacement only in conjunction with the movable plate.

Furthermore, the novel arrangement of the spare or second discharge opening in the bottom plate produces an extremely favorable configuration of the discharge openings of the pair of plates. Thus, the two plates have elliptical peripheral configurations, the smaller diameters of which are congruent in the closed position. With such external geometrical configurations, the pair of plates can be produced with a satisfactory degree of safety of the sliding surface seal between the two plates with a relatively small sliding surface area. This results in a considerable saving of the refractory material of the two plates.

In accordance with another aspect of the present invention, the peripheries of the bottom and movable plates include respective circular arc portions, including larger and smaller circular arc portions. The larger circular arc portions are centered about the center of rotation of the movable plate, and the larger circular arc portions of the two plates that are radially outwardly of the circular arc containing the operable discharge openings are congruent in the closed position. This construction of the pair of plates is quite simple and is especially advantageous for swivelling sliding closure units. However, such construction also is advantageous with rotary sliding closure units, particularly for those having a plurality of plate sectors.

In accordance with a further aspect of the present invention, there is provided a novel method of operation of such pair of plates. In accordance with such method, the bottom plate is mounted with a first discharge opening thereof aligned with the vessel outlet opening, and with a second discharge opening thereof provided as the spare discharge opening. The movable plate is operated to align a third discharge opening thereof with the first discharge opening to discharge molten metal from the vessel, and to align a fourth discharge opening thereof with the first discharge opening to supply material to the first discharge opening and to the outlet opening. After wear of the operable discharge openings has occurred, the bottom plate is rotated by 180° in the sliding plane, and the bottom plate is mounted with the second discharge opening aligned with the vessel outlet opening, and with the previously depleted first discharge opening positioned out of alignment therewith. The movable plate also is rotated by 180° in the sliding plane. Thereafter, the movable plate is operated to align the fourth discharge opening with the second discharge opening to discharge molten metal from the vessel and to align the third discharge opening with the second discharge opening to supply material to the second discharge opening and to the vessel outlet opening. This method results in even loading and thereby even wear of the pair of refractory plates. This further makes it possible to introduce, as necessary and without difficulty, through the particular material supply opening and thereby into the vessel outlet opening various gasses or materials employable, as would be understood by one skilled in the art, to burn out frozen metal within the discharge and outlet openings or to subject the molten metal within the vessel to a particular metallurgical treatment.

BRIEF DESCRIPTION OF THE DRAWINGS

Other objects, features and advantages of the present invention will be described below, with reference to the accompanying drawings, wherein.

DETAILED DESCRIPTION OF THE INVENTION

Figure 1:
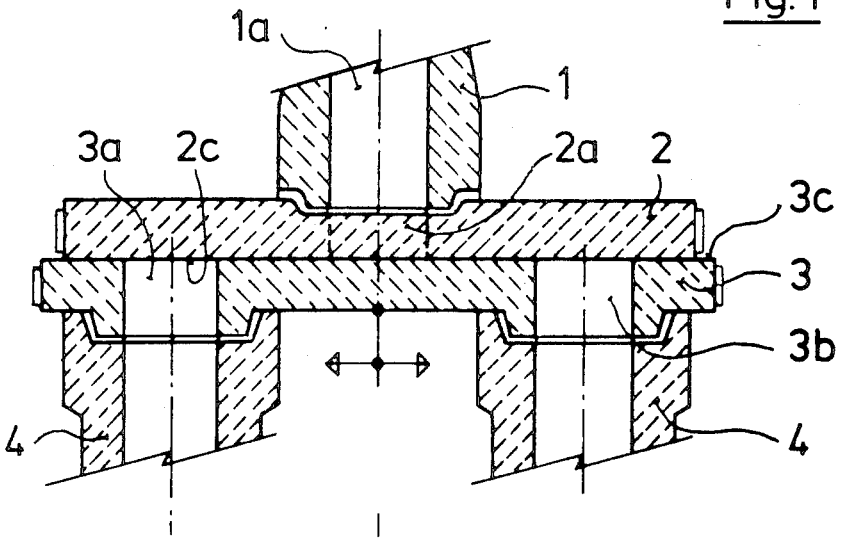
FIG. 1 is a partial cross sectional view of a pair of refractory plates according to the present invention, shown in a closed position.

Reference numeral 1 in the drawings indicates a refractory inlet sleeve to be arranged in the refractory lining of a metallurgical vessel. A swivelling slide gate or sliding closure unit according to the present, invention includes a stationary bottom plate 2 fixed in position beneath the sleeve 1 and a swivelly movable plate 3 mounted for sliding movement with respect to bottom plate 2. Inlet sleeve 1 has therethrough an outlet opening 1*a*, bottom plate 2 has therethrough a pair of discharge openings 2*a*, 2*b* and movable plate 3 has therethrough a pair of discharge openings 3*a*, 3*b*. Plates 2, 3 have respective abutting, complementary sliding surfaces 2*c*, 3*c*, and plate 3 is pressed against plate 2 such that there is a sliding seal formed between surfaces 2*c*, 3*c*. Mounted beneath plate 3 are a pair of discharge sleeves 4 having openings aligned with respective discharge openings 3*a*, 3*b*, in a conventional manner.

Figure 4:
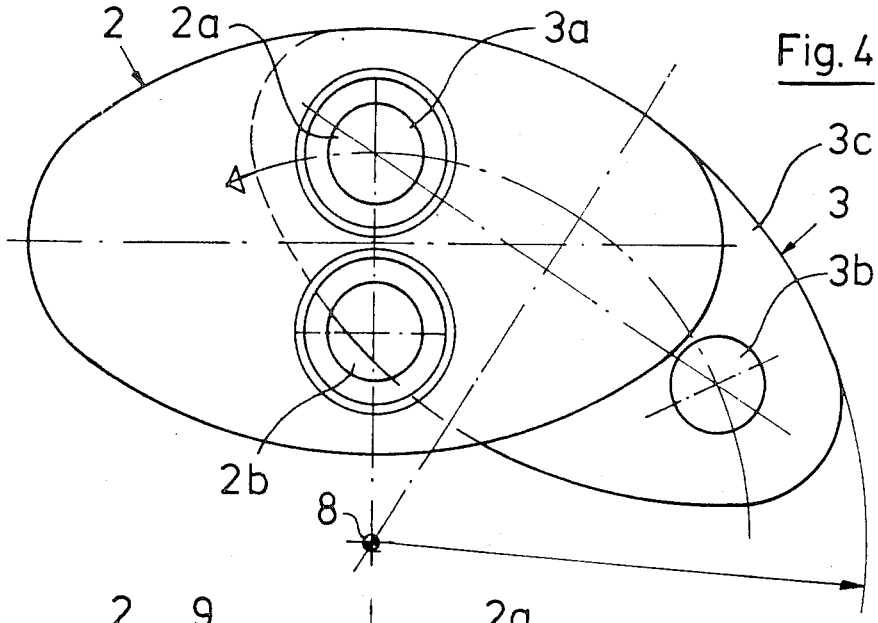
FIG. 4 is a view similar to FIG. 2, but illustrating one open position thereof.

Plate 2 is mounted with one of the discharge openings thereof in alignment with outlet opening 1*a*. In the illustrated arrangement, opening 2*a* is so aligned. Movable plate 3 is mounted for sliding movement with respect to bottom plate 2 about a center of rotation 8 between a closed position, shown in FIGS. 1 and 2, whereat neither of discharge openings 3*a*, 3*b* of movable plate 3 are aligned with discharge opening 2*a* of bottom plate 2, and alternate open positions, whereat respective of the discharge openings 3*a*, 3*b* of the movable plate 3 are in alignment with discharge opening 2*a* of bottom plate 2. One such open position is shown in FIG. 4, wherein discharge opening 3*a* of plate 3 is aligned with discharge opening 2*a* of plate 2. In this position, molten material is discharged from the metallurgical vessel. The discharge openings 3*a*, 2*a*, 3*b* are centered on a common circular arc 7 centered about center of rotation 8, and in the closed position shown in FIG. 2 the movable plate 2 is positioned such that discharge openings 3*a*, 3*b* are positioned symmetrically on opposite sides of discharge opening 2*a*.

In accordance with the present invention, the second discharge opening 2*b* of bottom plate 2 is located at a position between circular arc 7 and center of rotation 8, and discharge openings 2*a*, 2*b* are centered on a radial line extending from center of rotation 8 and intersecting circular arc 7. This radial line corresponds to a radial center line 5 between discharge openings 3*a*, 3*b* in the closed position, as shown in FIG. 2.

Figure 2:
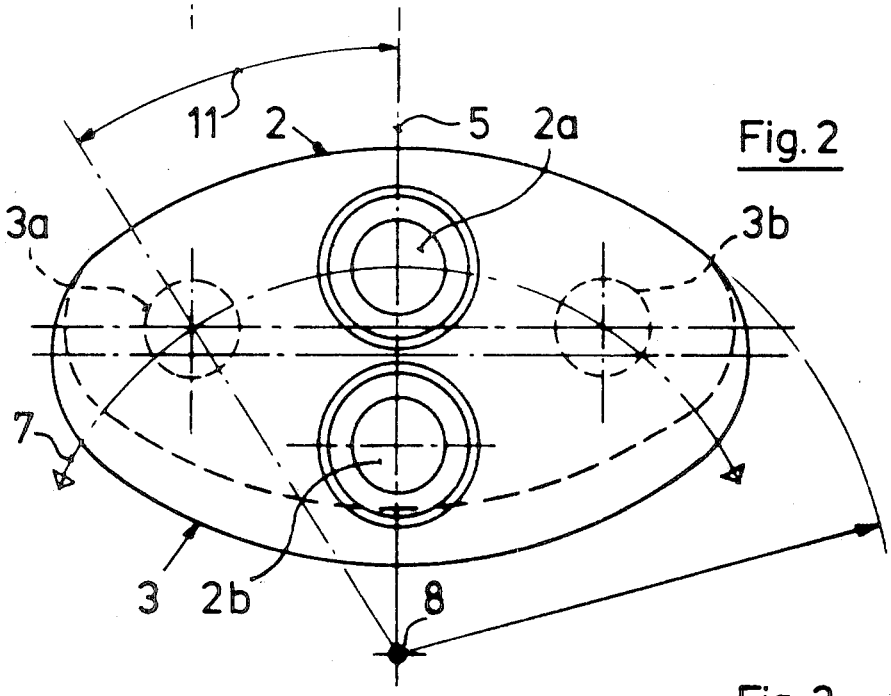
FIG. 2 is a plan view from the top of the stationary bottom plate thereof.
Figure 3:
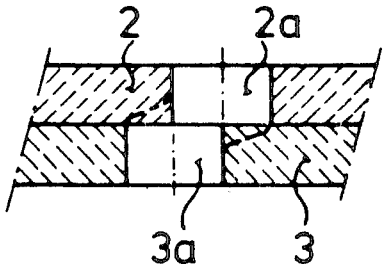
FIG. 3 is a partial section through the two plates shown in an open throttled position and illustrating wear of the plates.
Figure 5:
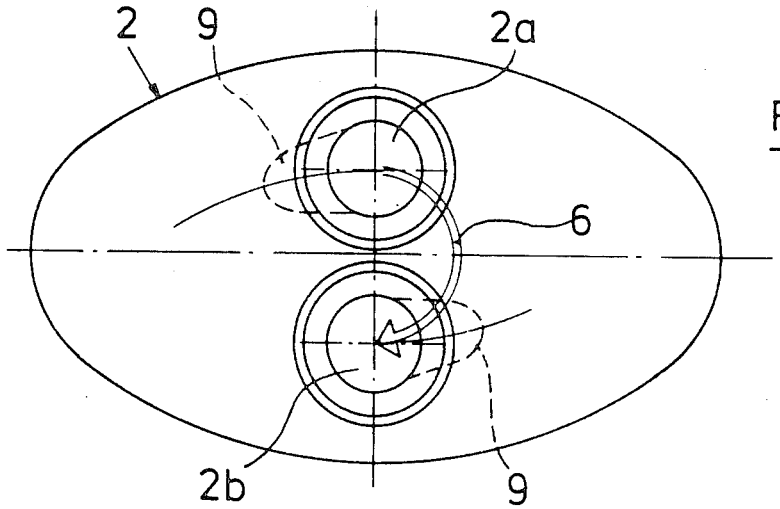
FIG. 5 is a top plan view of the stationary bottom plate, after wear thereof and schematically illustrating the manner of rotation thereof according to the present invention.
Figure 6:
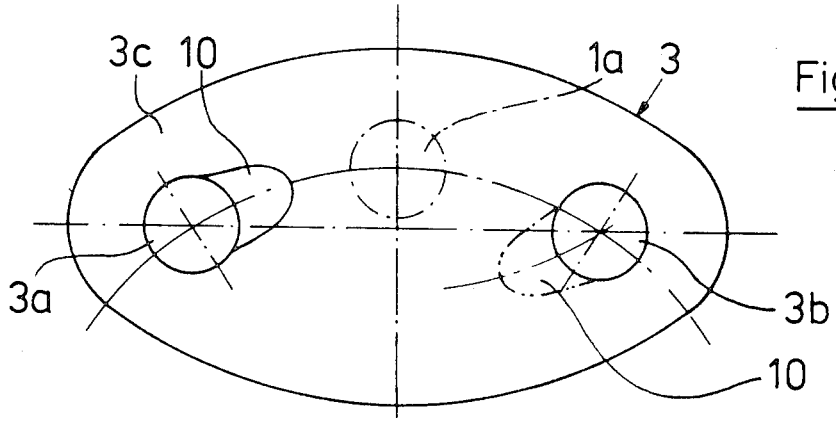
FIG. 6 is a top plan view of a movable plate, shown after wear thereof in a manner similar to the illustration of FIG. 5.

When the movable plate 3 is operated from the closed position shown in FIG. 2 to the open position shown in FIG. 4, then wear and erosion of plates 2, 3 occurs in the areas indicated by dashed lines in FIG. 3. These areas of wear are shown in FIGS. 5 and 6 by respective reference numerals 9, 10 associated with discharge openings 2*a*, 3*a*. These areas of wear result by the deflection of the discharged stream of molten metal in the throttled position shown in FIG. 3, and also by infiltration of the molten metal between the sliding surfaces 2*c*, 3*c*, primarily in the areas of the throttling edges of the plates. If such infiltrated melt, particularly steel melt, becomes solidified, then both plates will be damaged during movement of the sliding plate with respect to the bottom plate during subsequent operation. This wear and damage occur in tongue-shaped areas somewhat following the path of circular arc 7, as will be particularly apparent from FIGS. 5 and 6.

In accordance with the present invention, when such wear occurs, bottom plate 2 may be rotated by 180° in the sliding plane, as indicated by arrow 6 in FIG. 5, such that thereafter discharge opening 2*b* is aligned with outlet opening 1*a*. Similarly, movable plate 3 may be rotated by 180° in the sliding plane, such that the positions of discharge openings 3*a*, 3*b* are reversed from the previous locations. This will result in the formation of wear area 10 illustrated in FIG. 6 in association with discharge opening 3*b*, during movement of the movable plate between the positions shown in FIGS. 2 and 4. It will be apparent that in accordance with the present invention it is only necessary to replace the bottom plate 2 when it is necessary to replace the movable plate 3. This increases the service life of the movable plate 2 and improves the overall operating efficiency of an installation.

FIGS. 5 and 6 illustrate wear of plates 2 and 3 by operation of only one discharge opening of movable plate 3 with each discharge opening of stationary bottom plate 2. Specifically, the wear patterns illustrated in FIGS. 5 and 6 result from movement of movable plate 3 from the position shown in FIG. 2 through an angle 11 to the position shown in FIG. 4. It would be possible to also move plate 3 from the closed position of FIG. 2 counterclockwise with respect thereto to bring discharge opening 3b into an open position in alignment with discharge opening 2a, and when the two plates are rotated 180° similarly to provide such counterclockwise movement to bring discharge opening 3a into alignment with discharge opening 2b. This would result in the formation of wear patterns 9 on plate 2 in directions opposite to the directions illustrated in FIG. 5 and also wear patterns 10 on plate 3 along oppositely directed of the circular arcs. In other words, with respect to FIG. 6, such arrangement would provide for a wear pattern 10 extending downwardly and to the right from discharge opening 3a and a wear pattern directed upwardly and to the left from discharge opening 3b. In other words, it is possible in accordance with the present invention to provide for operation resulting in two tongue-shaped worn portions 9 or 10 extending from each of the discharge openings 2a, 2b, 3a, 3b.

In accordance with a further aspect of the present invention, it is useful to operate the pair of plates in the manner illustrated in FIGS. 4–6 to provide for wear patterns 9 or 10 in only a single direction from each discharge opening, i.e. for bringing only one of the discharge openings of movable plate 3 into alignment with the operative discharge opening of the bottom plate for a given orientation of the two plates, while employing the other discharge opening of the movable plate as a material supply opening. Thus, in accordance with such method of operation, the plates first are positioned as illustrated in FIGS. 2 and 4, with bottom plate 2 being mounted with first discharge opening 2a aligned with vessel outlet opening 1a. Movable plate 3 is operated to align third discharge opening 3a with first discharge opening 2a to discharge molten metal from the vessel. Fourth discharge opening 3b is aligned with first discharge opening 2a only as a material supply opening. For example, it is possible to provide opening 3b with an injector nozzle for injecting oxygen into openings 2a, 1a to burn out metal which becomes frozen therein. Furthermore, it is possible to employ opening 3b to introduce gases or other substances into the metallurgical vessel through the burn-out opening. After discharge openings 2a, 3a have become worn as indicated at 9, 10, then the bottom plate is rotated by 180° in the sliding plane, and the bottom plate is then mounted with second discharge opening 2b aligned with vessel outlet opening 1a. Also, movable plate 3 is rotated by 180° in the sliding plane. Thereafter, movable plate 3 then is operated to align fourth discharge opening 3b with second discharge opening 2b to discharge molten metal from the vessel. Similarly, third discharge opening 3a then is aligned with second discharge opening 2b only to supply material to the second discharge opening 2b and to outlet 1a.

The above structural arrangement of the plates 2 and 3 makes it possible to provide the plates with elliptical peripheral configurations. Such peripheries are formed by respective larger circular arc portions spaced by smaller diameters and by respective smaller circular arc portions spaced by larger diameters. As will be apparent from FIG. 2 of the drawings, when the movable plate is in the closed position, the smaller diameters of the two plates are congruent. Furthermore, the outermost circular arc portions of the two plates are centered about the center of rotation 8, and such outer circular arc portions are congruent in the closed position, as shown in FIG. 2. In accordance with the present invention, it is possible to construct the movable plate 3 of a smaller size than the stationary bottom plate 2. This is illustrated by the dashed horizontal center lines in FIG. 2, the upper such horizontal line being the center line of movable plate 3, and the lower such horizontal line being the center line of bottom plate 2. It thereby is possible to provide a saving of the refractory material.

Although the present invention has been described with respect to a two-plate sliding closure unit, it is possible to employ the concepts of the present invention in a three-plate sliding closure unit wherein a lower stationary plate is provided, as would be understood by one skilled in the art, with a configuration corresponding to that of plate 2.

Although the present invention has been described and illustrated with respect to preferred features thereof, it is to be understood that various modifications and changes may be made to the specifically described and illustrated features without departing from the scope of the present invention.

We claim:

1. In a pair of refractory plates for use in a swivelling sliding closure unit, particularly for controlling the discharge of molten metal from a metallurgical vessel, said pair of refractory plates including a stationary bottom plate having a discharge opening and to be mounted beneath a vessel with said discharge opening aligned with an outlet opening of the vessel, and a movable plate having two discharge openings, said movable plate being mounted for sliding movement with respect to said bottom plate about a center of rotation between a closed position, whereat neither of said discharge openings of said movable plate are aligned with said discharge opening of said bottom plate, and alternate open positions, whereat respective said discharge openings of said movable plate are in alignment with said discharge opening of said bottom plate, said discharge openings of said movable and bottom plates being centered on a common circular arc centered about said center of rotation, and said discharge openings of said movable plate being positioned symmetrically on opposite sides of said discharge opening of said bottom plate in said closed position, the improvement wherein:

said bottom plate has a second discharge opening at a position between said circular arc and said center of rotation; and said discharge openings of said bottom plate are centered on a radial line extending from said center of rotation and intersecting said circular arc, said radial line corresponding to a radial center line between said discharge openings of said movable plate in said closed position.

2. The improvement claimed in claim 1, wherein said bottom and movable plates each have elliptical peripheral configurations with smaller diameters which are congruent in said closed position.

3. The improvement claimed in claim 2, wherein the peripheries of said bottom and movable plates include respective circular arc portions centered about said center of rotation.

4. The improvement claimed in claim 3, wherein said circular arc portions are congruent in said closed position.

5. A method of operating a pair of refractory plates of a swivelling sliding closure unit, particularly for controlling the discharge of molten metal from a metallurgical vessel, said pair of refractory plates including a stationary bottom plate having first and second discharge openings and mounted beneath a vessel with one of said discharge openings aligned with an outlet opening of said vessel, and a movable plate having third and fourth discharge openings, said movable plate being slidable with respect to said bottom plate about a center of rotation between a closed position, whereat said third and fourth discharge openings are out of alignment with said one discharge opening, and alternate open positions, whereat said third and fourth discharge openings respectively are in alignment with said one discharge opening, said third and fourth discharge openings being centered on a common circular arc centered about said center of rotation, said first and second discharge openings being centered on a radial line extending from said center of rotation and intersecting said circular arc, and said radial line corresponding to a radial center line between said third and fourth discharge openings in said closed position, said method comprising:

mounting said bottom plate with said first discharge opening as said one discharge opening aligned with said vessel outlet opening;

operating said movable plate to align said third discharge opening with said first discharge opening to discharge molten metal from the vessel, and to align said fourth discharge opening with said first discharge opening to supply material to said first discharge opening and to said outlet opening;

thereafter, rotating said bottom plate by 180° in the sliding plane and mounting said bottom plate with said second discharge opening as said one discharge opening aligned with said vessel outlet opening;

rotating said movable plate by 180° in said sliding plane; and thereafter, operating said movable plate to align said fourth discharge opening with said second discharge opening to discharge molten metal from said vessel, and to align said third discharge opening with said second discharge opening to supply material to said second discharge opening and to said outlet opening.

* * * * *